US008113510B2

(12) United States Patent
Kurosu

(10) Patent No.: US 8,113,510 B2
(45) Date of Patent: Feb. 14, 2012

(54) SHEET PROCESSING APPARATUS AND IMAGE FORMING APPARATUS

(75) Inventor: Yuki Kurosu, Nagareyama (JP)

(73) Assignee: Canon Finetech Inc., Misato-shi (JP)

( * ) Notice: Subject to any disclaimer, the term of this patent is extended or adjusted under 35 U.S.C. 154(b) by 0 days.

(21) Appl. No.: 12/878,164

(22) Filed: Sep. 9, 2010

(65) Prior Publication Data

US 2011/0062648 A1 Mar. 17, 2011

(30) Foreign Application Priority Data

Sep. 14, 2009 (JP) ..... 2009-212458
Jul. 16, 2010 (JP) ..... 2010-161371

(51) Int. Cl.
*B65H 31/36* (2006.01)
*B65H 9/16* (2006.01)

(52) U.S. Cl. ..... 271/222; 271/250

(58) Field of Classification Search ..... 271/248, 271/252, 249, 250, 253, 3.03, 3.02, 220–222, 271/224, 248–50
See application file for complete search history.

(56) References Cited

U.S. PATENT DOCUMENTS

| | | | | |
|---|---|---|---|---|
| 5,120,047 | A * | 6/1992 | Mandel et al. | 271/220 |
| 5,199,703 | A * | 4/1993 | Hess | 271/314 |
| 6,142,466 | A * | 11/2000 | Dickhoff | 271/220 |
| 7,300,046 | B2 * | 11/2007 | Sugiyama et al. | 270/58.17 |
| 7,392,983 | B2 * | 7/2008 | Kodama et al. | 271/249 |
| 2005/0230898 | A1 * | 10/2005 | Suqiyama et al. | 270/58.08 |
| 2009/0212487 | A1 * | 8/2009 | Okamoto et al. | 271/220 |

FOREIGN PATENT DOCUMENTS

JP 2005-306528 11/2005

* cited by examiner

*Primary Examiner* — Kaitlin Joerger
*Assistant Examiner* — Patrick Cicchino
(74) *Attorney, Agent, or Firm* — Fitzpatrick, Cella, Harper & Scinto

(57) ABSTRACT

A sheet processing apparatus that processes sheets transported in a transport direction and stacked on a tray, including: a sheet moving device configured to be brought into contact with an upper surface of a sheet stacked on the tray and to be moved in a width direction intersecting with the transport direction to move the sheet in the width direction; an alignment member against which a side edge of the sheet moved in the width direction by the sheet moving device is brought into abutment, to align the sheet; and a guide member configured to hold down the sheet between the sheet moving device and the alignment member with the sheet moving device in contact with the upper surface of the sheet, wherein the guide member is moved integrally with the sheet moving device in the width direction.

6 Claims, 10 Drawing Sheets

SHEET PROCESSING APPARATUS AND IMAGE FORMING APPARATUS

BACKGROUND OF THE INVENTION

1. Field of the Invention

The present invention relates to a sheet processing apparatus, and more particularly, to a sheet processing apparatus that regulates, in a width direction, a position of a sheet to be processed, and to an image forming apparatus including the sheet processing apparatus.

2. Description of the Related Art

Heretofore, as an image forming apparatus such as a copier, a printer, a facsimile machine, and a multifunctional printer, there is known an image forming apparatus main body which is provided with a sheet processing apparatus, where sheets are delivered from the image forming apparatus main body after image formation to the sheet processing apparatus which implements a process such as a binding process for the sheets. In the sheet processing apparatus, the sheets delivered from the image forming apparatus main body are transported to a sheet processing portion. Then, the sheet processing portion implements, for the delivered sheets, processes such as a stacking/aligning operation of stacking and aligning the sheets, and a stapling operation of binding the sheets.

As a conventional sheet processing apparatus, an apparatus has been disclosed, in which a sheet moving device moves the sheets in a width direction intersecting with a sheet transporting direction, and allows side edges of the sheets to abut against an abutting member, to thereby align the sheets. Here, in the sheet processing apparatus, a sheet holding-down member that suppresses curling of such side edge portions of the sheets is placed in the vicinity of the abutting member (Japanese Patent Application Laid-Open No. 2005-306528).

However, the sheet holding-down member is fixed with respect to the width direction, and hence a distance between the sheet moving device and the sheet holding-down member at the time when the sheet moving device aligns sheets of a large size becomes larger than a distance between the sheet moving device and the sheet holding-down member at the time when the sheet moving device aligns sheets of a small size. Hence, in the case of aligning the sheets of the large size, there is a fear that the sheets may buckle between the sheet moving device and the sheet holding-down member to thereby adversely affect alignment characteristics, compared with the case of aligning the sheets of the small size.

SUMMARY OF THE INVENTION

Therefore, the present invention has been made in consideration of the actual circumstances as described above. It is an object of the present invention to provide a sheet processing apparatus capable of suppressing buckling of sheets in a width direction thereof regardless of a size of the sheet when aligning the sheets in the width direction thereof, and to provide an image forming apparatus including the sheet processing apparatus.

The present invention provides a sheet processing apparatus that processes sheets transported in a predetermined transport direction and stacked on a processing tray, the sheet processing apparatus including: a sheet moving device configured to be brought into contact with an upper surface of a sheet stacked on the processing tray and to be moved in a width direction intersecting with the predetermined transport direction to move the sheet in the width direction; an alignment member against which a side edge of the sheet moved in the width direction by the sheet moving device is brought into abutment, to align the sheet; and a guide member configured to hold down the sheet from above at a predetermined position between the sheet moving device and the alignment member when the sheet moving device is in contact with the upper surface of the sheet, in which the guide member is moved integrally with the sheet moving device when the sheet moving device is moved in the width direction.

According to the present invention, when the sheet moving device is moved in the width direction, the guide member is moved integrally with the sheet moving device. In this case, when aligning the sheet in the width direction, the buckling of the sheet in the width direction may be suppressed, regardless of the size of the sheet.

Further features of the present invention will become apparent from the following description of exemplary embodiments with reference to the attached drawings.

DESCRIPTION OF THE EMBODIMENT

An embodiment of the present invention is described below in detail with reference to the drawings.

Figure 1:
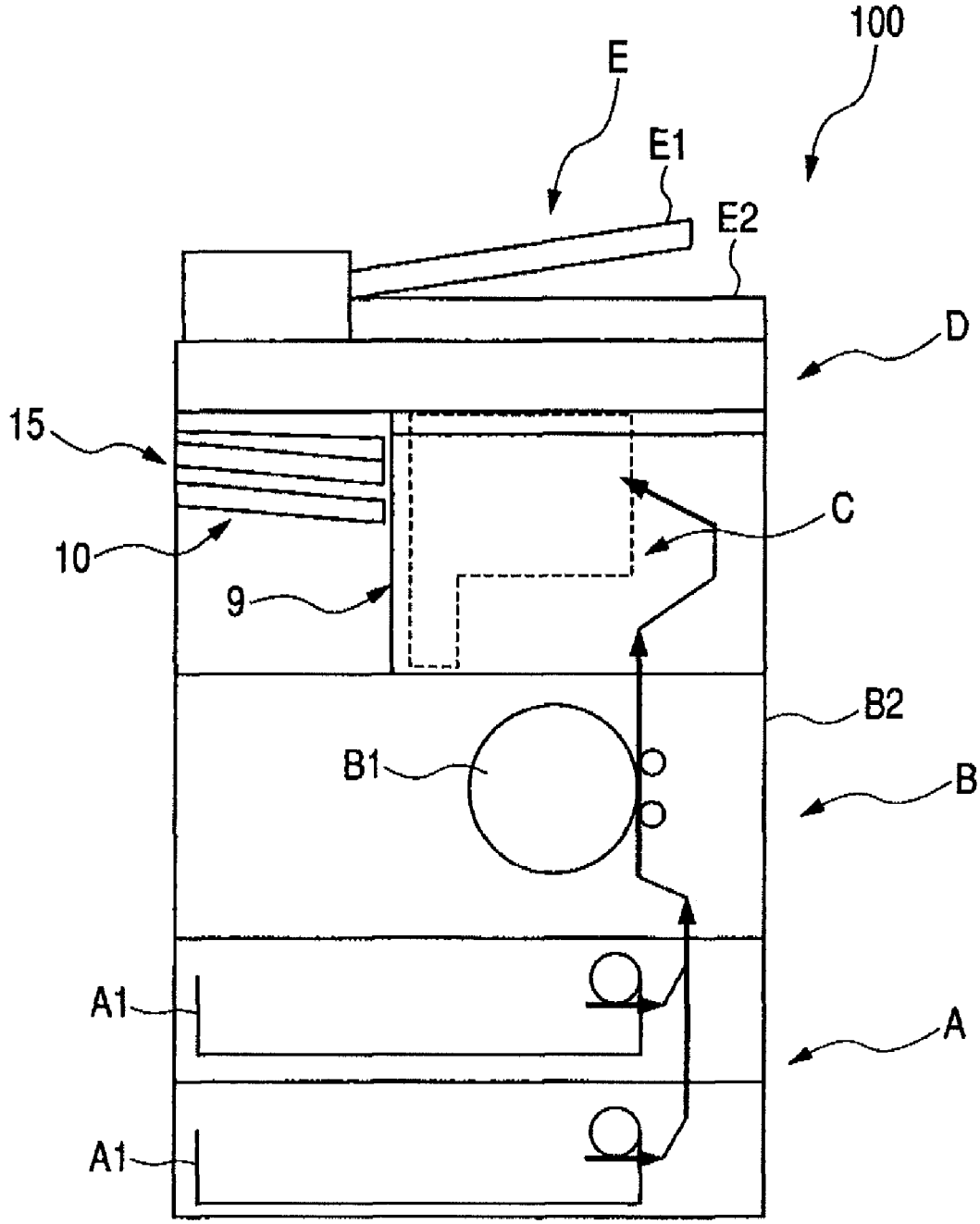
FIG. 1 is a schematic view illustrating an entire image forming system that includes a sheet processing apparatus according to an embodiment of the present invention.
Figure 2:
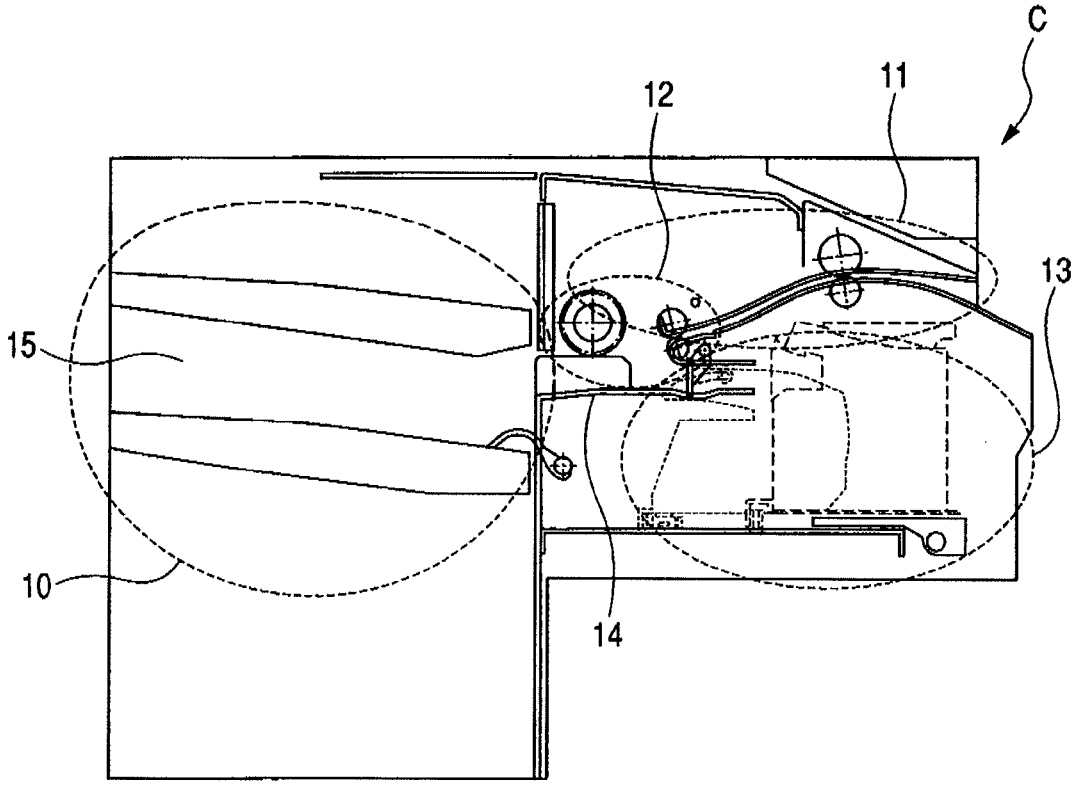
FIG. 2 is a cross-sectional view schematically illustrating a cross section of the sheet processing apparatus.
Figure 3:
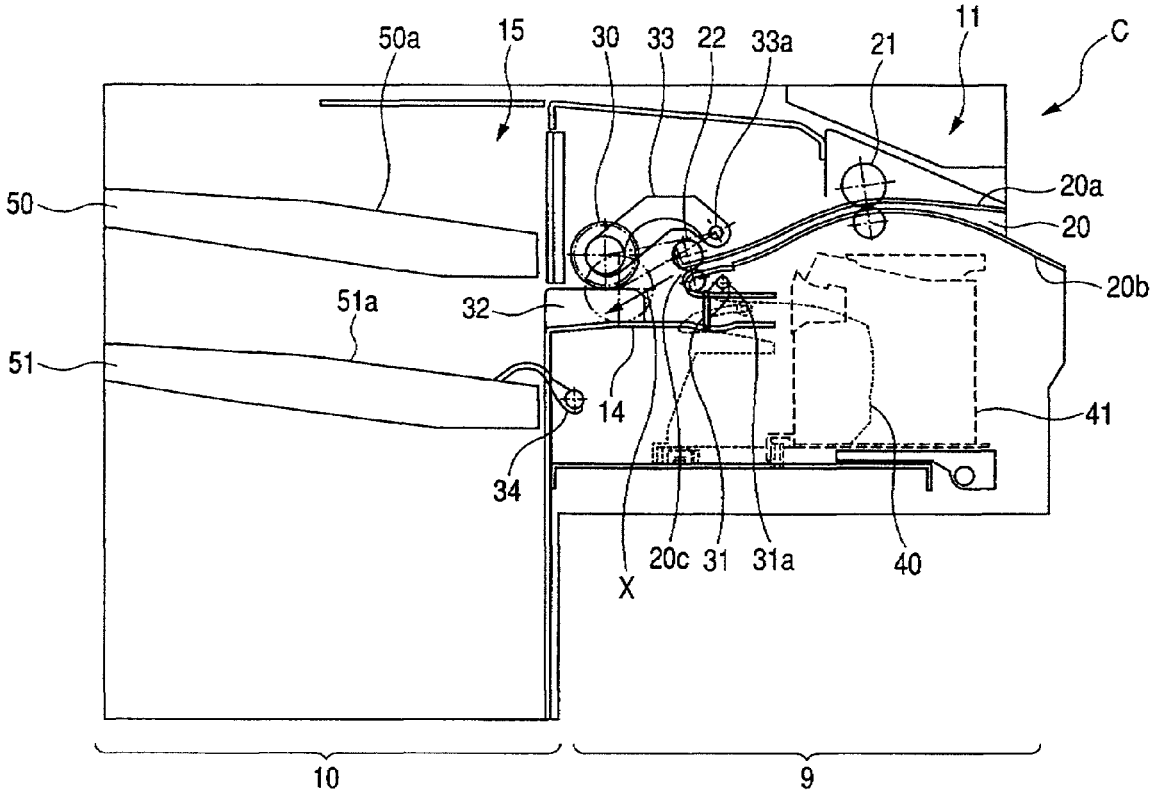
FIG. 3 is a cross-sectional view schematically illustrating details of the sheet processing apparatus.

FIG. 1 is a schematic view illustrating an entire image forming system that includes a sheet processing apparatus according to the embodiment of the present invention, and FIG. 2 and FIG. 3 are schematic cross-sectional views of the sheet processing apparatus. As illustrated in FIG. 1, an image forming system 100 includes a sheet feeding apparatus A, an image forming apparatus B provided with an image forming apparatus main body B2, a sheet processing apparatus (hereinafter, simply referred to as "processing apparatus") C, an original reading apparatus D, and an original transport apparatus E.

The original transport apparatus E transports originals, which are set on an original tray E1, one by one onto a platen glass of the original reading apparatus D, and delivers the originals onto a delivery tray E2. At this time, the original reading apparatus D reads the originals, which pass on the platen glass by the original transport apparatus E, by a reading device (not shown). Note that, the reading device includes a lamp, multiple mirrors, a lens, and an image sensor. Then, light emitted from the lamp of the reading device is reflected on a surface of an original, and is guided through the multiple mirrors and the lens to the image sensor. In this manner, an image is read by the image sensor. Image data of the original read by the image sensor is subjected to a predetermined image processing, and is transferred to an exposure control unit (not shown) of the image forming apparatus main body B2.

The exposure control unit of the image forming apparatus main body 82 outputs a laser beam according to an image signal. The laser beam is irradiated onto a photosensitive drum B1 while being scanned by a polygon mirror. An electrostatic latent image corresponding to the scanned laser beam is formed on the photosensitive drum B1. The electrostatic latent image formed on the photosensitive drum B1 is developed by a developing unit (not shown), and is visualized as a toner image.

The sheet feeding apparatus A includes multiple cassettes A1. A sheet on which the image is to be formed is transported from any one of the multiple cassettes A1 of the sheet feeding apparatus A to a transfer portion of the image forming apparatus main body B2. Then, the visualized toner image is transferred, in the transfer portion, to the sheet transported from the sheet feeding apparatus A, and the image is formed on the sheet. The sheet to which the image is transferred is then subjected to a fixing process in a fixing portion. Then, the sheet which has passed through the fixing portion is transported to the processing apparatus C. The sheets transported to the processing apparatus C are subjected to a process such as binding and folding by a processing portion 9, and are then delivered to a containing portion 10.

Next, the processing apparatus C according to the embodiment of the present invention will be described based on FIG. 1 to FIG. 3.

As illustrated in FIG. 1, the processing apparatus C is disposed between the image forming apparatus main body B2 and the original reading apparatus D. The processing portion 9 including a binding device is provided on one end side of the processing apparatus C in a horizontal direction. The containing portion 10 that contains the processed sheets is provided on the other end side of the processing apparatus C. The containing portion 10 is provided in a delivery space 15 formed between the image forming apparatus main body B2 and the original reading apparatus D. Specifically, the image forming system 100 has a so-called in-body delivery function to contain the processed sheets in the delivery space 15 between the image forming apparatus main body B2 and the original reading apparatus D.

FIG. 2 is the schematic cross-sectional view illustrating the respective functional units of the processing apparatus C. As illustrated in FIG. 2, the processing apparatus C includes a transport portion 11 that receives and transports the sheets coming from the image forming apparatus main body B2 and a processing tray 14 on which the sheets sent from the transport portion 11 are stacked. Further, the processing apparatus C includes an alignment portion 12 that aligns the sheets stacked on the processing tray 14, a gripper/stapler portion 13 that implements a staple process for the aligned sheets, and the containing portion 10 having multiple stack trays 50 and 51.

Next, based on FIG. 3, details will be described of the respective functional portions of the processing apparatus C that processes the sheets transported in a predetermined transporting direction and stacked on the processing tray 14.

In the transport portion 11, there are provided a transport path 20 that communicates with a delivery port (not shown) of the image forming apparatus main body B2 and a transport roller pair 21 that transports the sheet along the transport path 20. Further, a delivery roller pair 22 is provided on a delivery port 20*c* of the transport path 20. The delivery roller pair 22 sequentially delivers the sheet to the processing tray 14 arranged below the transport path 20. The transport path 20 includes a pair of guide plates 20*a* and 20*b* which guide the sheet. The delivery roller pair 22 transports the sheet in a transport direction X, and stacks the sheet on the processing tray 14. The sheets delivered by the delivery roller pair 22 are placed in a state of bridging over the processing tray 14 and sheet placing surfaces 50*a* and 51 of the stack trays 50 and 51 which will be described later, and are subjected to a predetermined process.

In the alignment portion 12, a stopper member 31 that aligns trailing edges of the sheets stacked on the processing tray 14 is provided. Forward and reversely rotatable shift rollers 30 contact an upper surface of the sheet stacked on the processing tray 14, and can thereby transport the sheet in the transport direction X and a direction reverse to the transport direction X. Further, the shift rollers 30 contact the upper surface of the sheet stacked on the processing tray 14, then move in a width direction Y (a direction indicated by the arrow Y in FIG. 9A) intersecting with the transport direction X, and can thereby move the sheet in the width direction Y. An alignment member 32 (refer to FIG. 5) is provided on one end portion of the processing tray 14 in the width direction Y. A side edge of the sheet in the width direction (intersecting with the transport direction X), which is moved in the width direction Y by the shift rollers 30 on the processing tray 14, is brought into abutment against the alignment member 32, to thereby align the sheet on the processing tray 14 in the width direction Y.

The stopper member 31 is configured to be freely rotatable about a support shaft 31*a* as a pivot, and can be moved between an alignment position in a vertical state and a retreat position in a substantially horizontal state. The shift rollers 30 are freely rotatably provided on one end side of an arm member 33 provided so as to be capable of moving up and down about, as a pivot, a support shaft 33*a* which has a polygon-shaped cross section. The shift rollers 30 are configured to be swingable, by a rotational operation of the arm member 33, between a contact position CP (FIG. 8A) in which the shift rollers 30 contacts the upper surface of the sheet stacked on the processing tray 14 and a retreat position RP (FIG. 8B) above the processing tray 14. When the shift rollers 30 are located at the retreat position RP, the shift rollers 30 are retreated apart from the sheet stacked on the processing tray 14. Note that, the arm member 33 is configured to be freely movable in the width direction Y along the support shaft 33*a*, and the shift rollers 30 are moved in the width direction Y by such movement of the arm member 33.

Figure 6A:
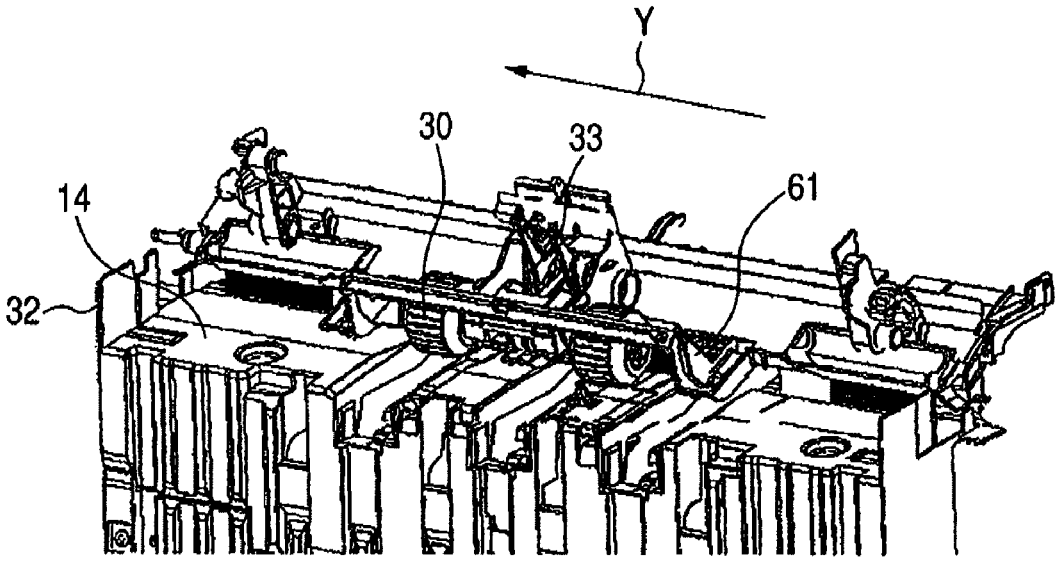
FIG. 6A is a view illustrating a shift roller and a guide member in an alignment portion of the sheet processing apparatus.
Figure 6B:
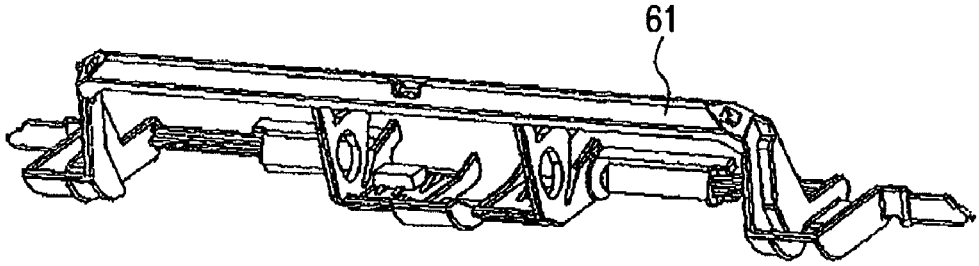
FIG. 6B is a view illustrating the guide member.
Figure 7:
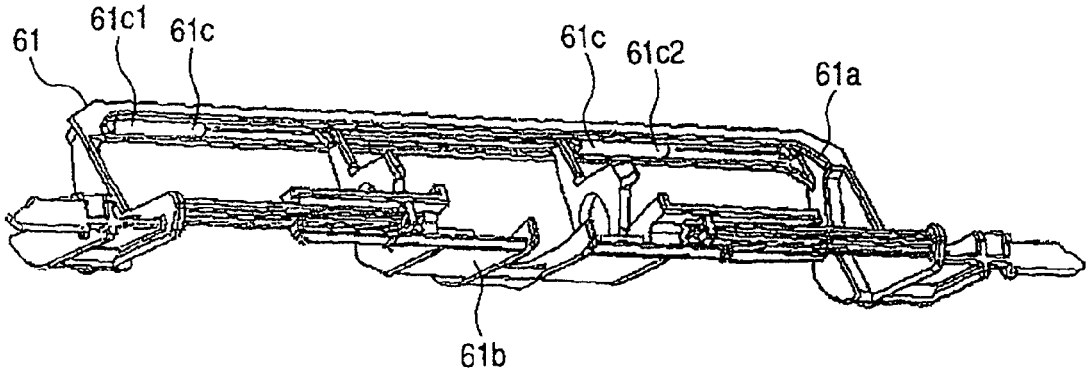
FIG. 7 is a view illustrating a configuration of the guide member.

Further, for such a sheet moving device (the shift rollers 30 and the arm member 33) configured to move the sheet in the width direction Y, a guide member 61 that is swingable in an up-and-down direction and slidable in the width direction Y is provided as illustrated in FIGS. 6A and 6B. Here, as illustrated in FIG. 7, this guide member 61 includes a holding-down guide 61*a* which holds down both end portions of the sheet in the width direction, from above. Further, the guide member 61 includes a guide holder 61*b* that holds down a center portion of the sheet from above and supports the holding-down guide 61*a* so as to be slidable in the width direction, and a spring (an elastic member) 61*c*. The guide holder 61*b* is configured to be slidingly movable with respect to the holding-down guide 61*a*. The spring 61*c* includes a first spring 61*c*1 and a second spring 61*c*2. The first spring 61*c*1 is an urging device configured to urge the holding-down guide 61*a* in a direction of the alignment member 32. The second spring 61*c*2 is an urging device configured to urge the holding-down guide 61*a* in a direction reverse to the direction of the alignment member 32. The first spring 61*c*1 and the second spring 61*c*2 are structured as described above, and accordingly, the guide member 61 is maintained in a neutral state with respect to the shift rollers 30 and the arm member 33.

Figure 8A:
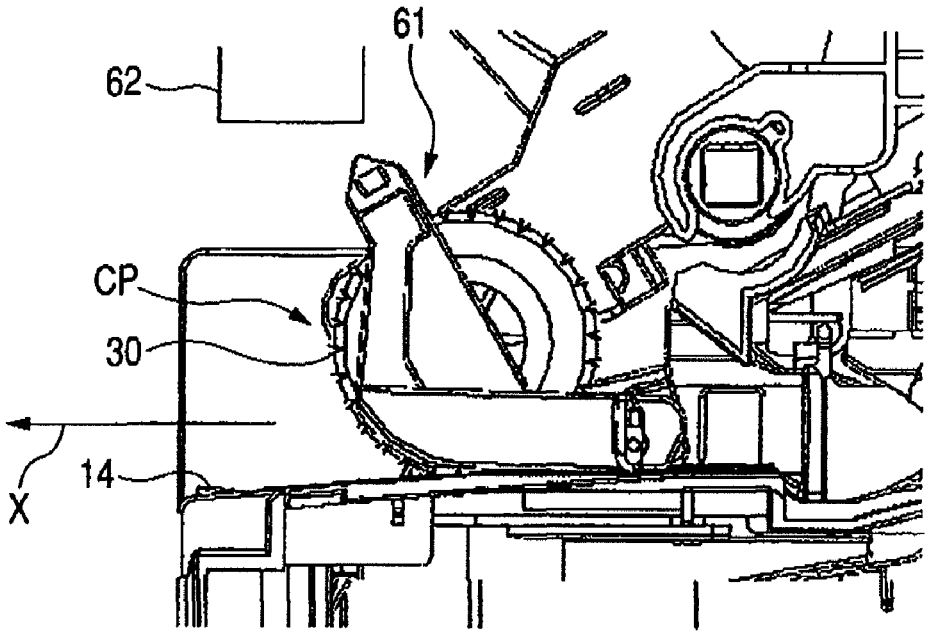
FIGS. 8A and 8B are views illustrating how the guide member swings upward and downward.
Figure 8B:
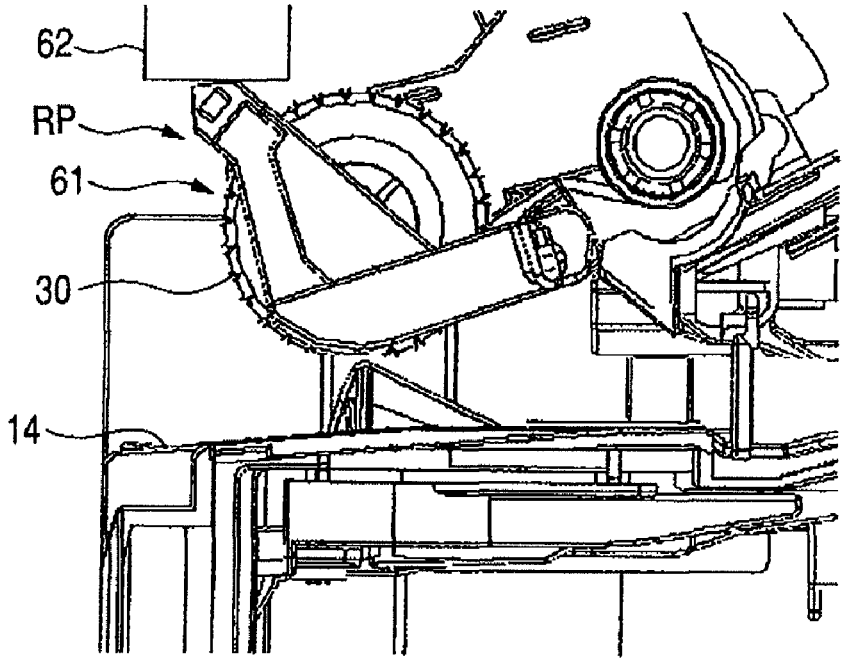

When the shift rollers 30 are lifted to be moved to the retreat position RP, the guide member 61 abuts against an abutment member 62 as illustrated in FIG. 8B, and takes an attitude capable of receiving the sheet transported from the upstream in the transport direction. At this time, the guide member 61 is on standby at a position of bringing the sheet, which is transported in the transport direction X from the upstream of the shift rollers 30, onto the processing tray 14. Further, when the shift rollers 30 are lowered to be moved to the contact position CP, as illustrated in FIG. 8A, the guide member 61 serves as a curl presser that acts on the sheet in the transport direction X of the sheet and presses the curl of the sheet. When the shift rollers 30 are in contact with the upper surface of the sheet as described above, the guide member 61 holds down the sheet from above at a predetermined position between the shift rollers 30 and the alignment member 32. Further, in this embodiment, the guide member 61 is configured so as to hold down the sheet, which is stacked on the processing tray 14, from above at a predetermined position on an opposite side of the shift rollers 30 to the alignment member 32 in the width direction Y.

Figure 9A:
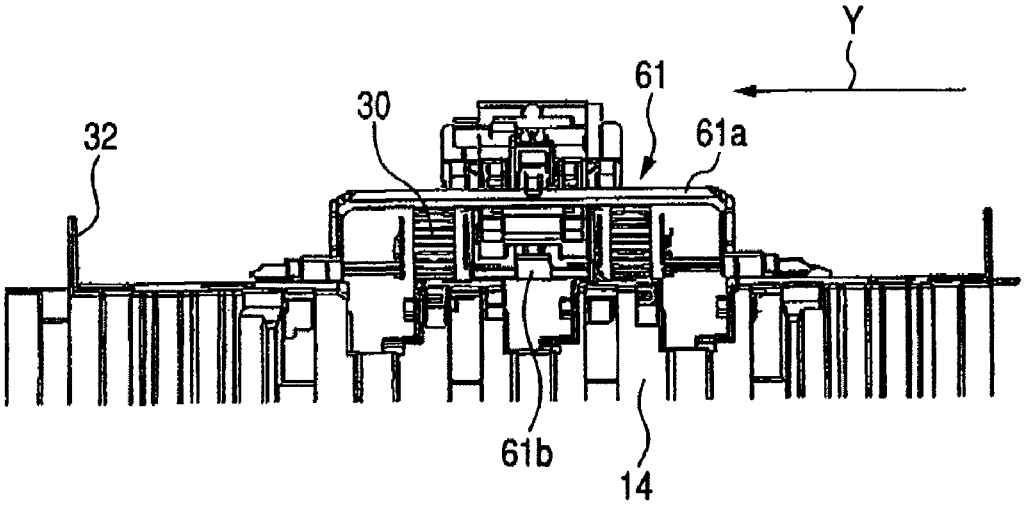
FIGS. 9A and 9B are views illustrating motions of the guide member in a width direction.
Figure 9B:
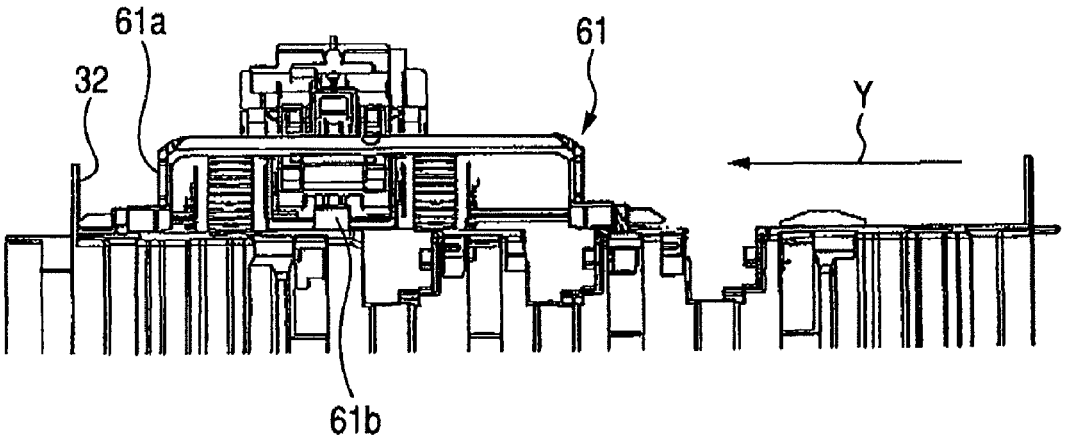

Further, as illustrated in FIGS. 9A and 9B, when the shift rollers 30 and the arm member 33 are moved in the width direction Y, the guide member 61 is also moved integrally therewith. In the case of moving a small-width sheet in the width direction Y by the shift rollers 30, a movement amount of the guide member 61 in the width direction Y is increased. In the case of the small-width sheet, an end portion of the holding-down guide 61*a* may be located at a position closer to the alignment member 32 than a side edge of the sheet. In such a case, not the side edge of the sheet but the end portion of the holding-down guide 61*a* abuts against the alignment member 32 (FIG. 9B).

However, as already described, the guide holder 61*b* is configured to be slidingly movable with respect to the holding-down guide 61*a*. In such a way, even in the case where the holding-down guide 61*a* abuts against the alignment member 32, only the guide holder 61*b* slides in the width direction Y against the spring 61*c* in a state where the holding-down guide 61*a* is maintained at a position of abutting against the alignment member 32. In such a way, the guide holder 61*b* moves in the width direction Y until the side edge of the sheet abuts against the alignment member 32 in a state where the holding-down guide 61*a* holds down the sheet. The guide member 61 is configured as described above, and hence, at the time of aligning the side edge of the sheet, the sheet can be held down in the width direction of the sheet, regardless of the sheet size.

Figure 10A:
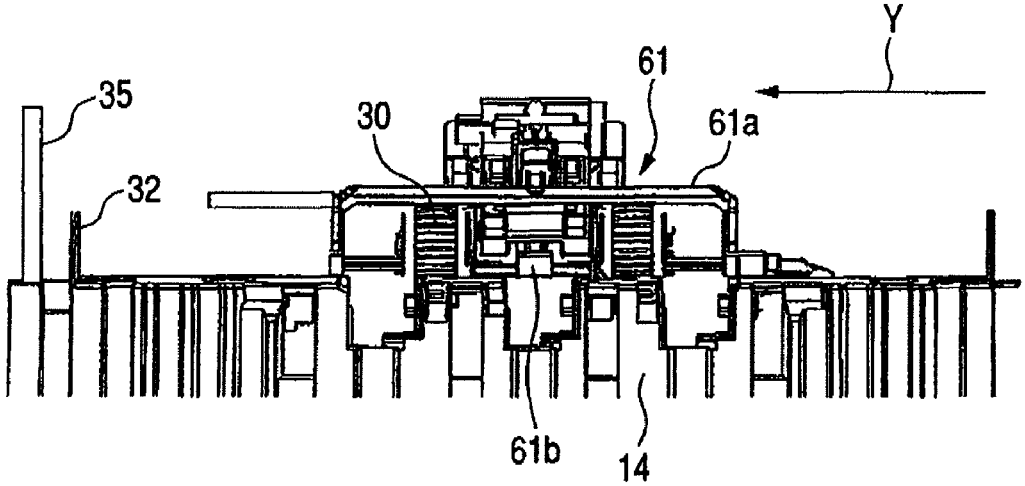
FIGS. 10A and 10B are views illustrating the motions of the guide member in the width direction.
Figure 10B:
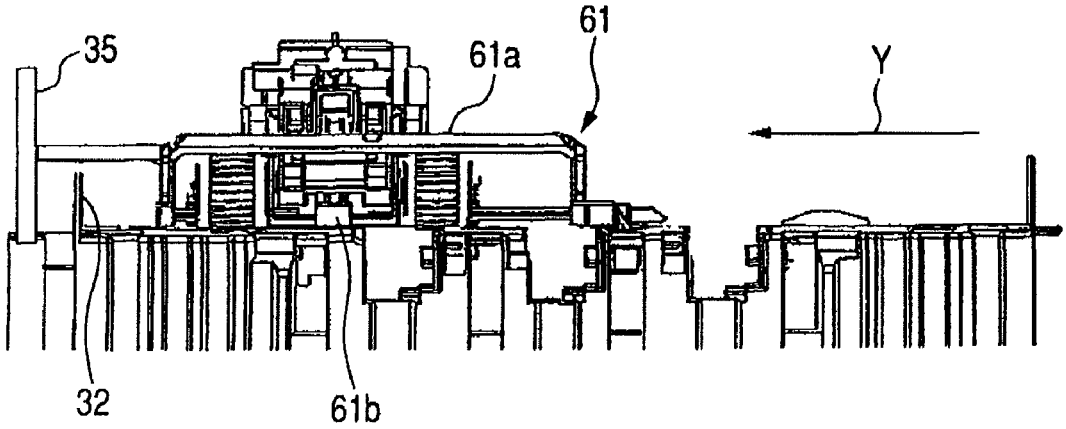

In this embodiment, the holding-down guide 61*a* is configured to strike against the alignment member 32. However, the present invention is not limited to this. For example, as illustrated in FIGS. 10A and 10B, a regulating member 35 may be provided on a frame (not shown) on an opposite side of the alignment member 32 to the shift rollers 30 in the width direction. Here, the sheet abuts against one surface of the alignment member 32. Specifically, the alignment member 32 and the regulating member 35 are not formed as the same member, but the regulating member 35 may be provided as a separate member from the alignment member 32, so that the holding-down guide 61*a* may strike against the regulating member 35 other than the alignment member 32. With such a configuration, after the holding-down guide 61*a* abuts against the regulating member 35, the holding-down guide 61*a* is maintained at a position of abutting against the regulating member 35, and only the guide holder 61*b* slides against the force of the spring 61*c*. In such a way, until the sheet strikes against the alignment member 32, the guide holder 61*b* slides while holding down the sheet. Further, the regulating member 35 may not be disposed at the above-mentioned position. The regulating member 35 may be disposed at a position where the holding-down guide 61*a* abuts against the regulating member 35 when the holding-down guide 61*a* is moved by a predetermined distance toward the alignment member 32.

Note that, when the alignment of the sheet is completed, the shift rollers 30 are first moved to the retreat position RP, and next, the arm 33 is moved in a direction away from the alignment member 32, which is reverse to the width direction Y, to thereby move the shift rollers 30 to an initial position located at a center of the processing tray 14. When the next sheet is delivered onto the processing tray 14, the shift rollers 30 repeat a similar alignment operation.

Figure 4A:
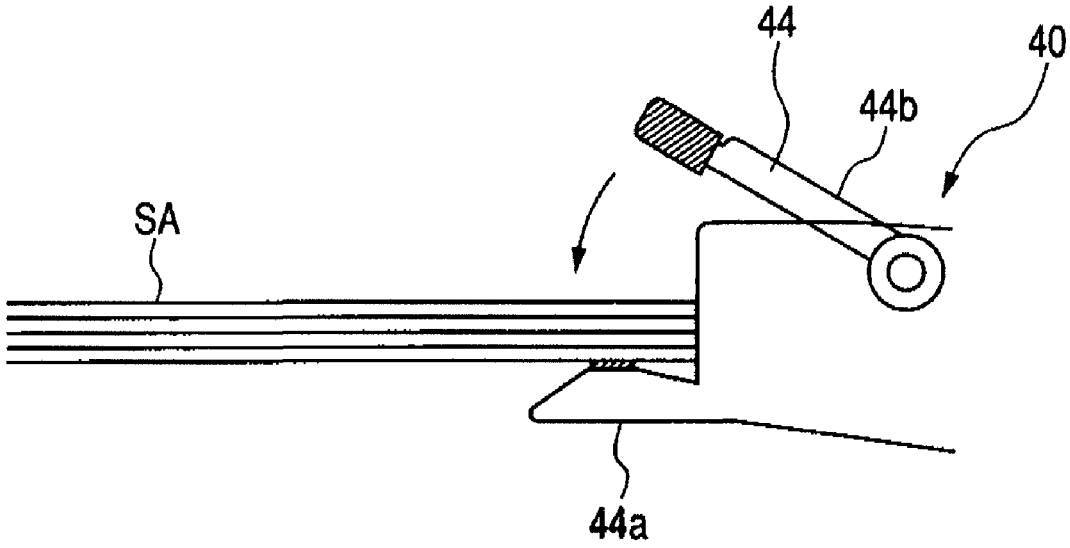
FIGS. 4A and 4B are schematic views schematically illustrating operation states where a gripper unit provided in a gripper/stapler portion of the sheet processing apparatus nips a sheet bundle.
Figure 4B:
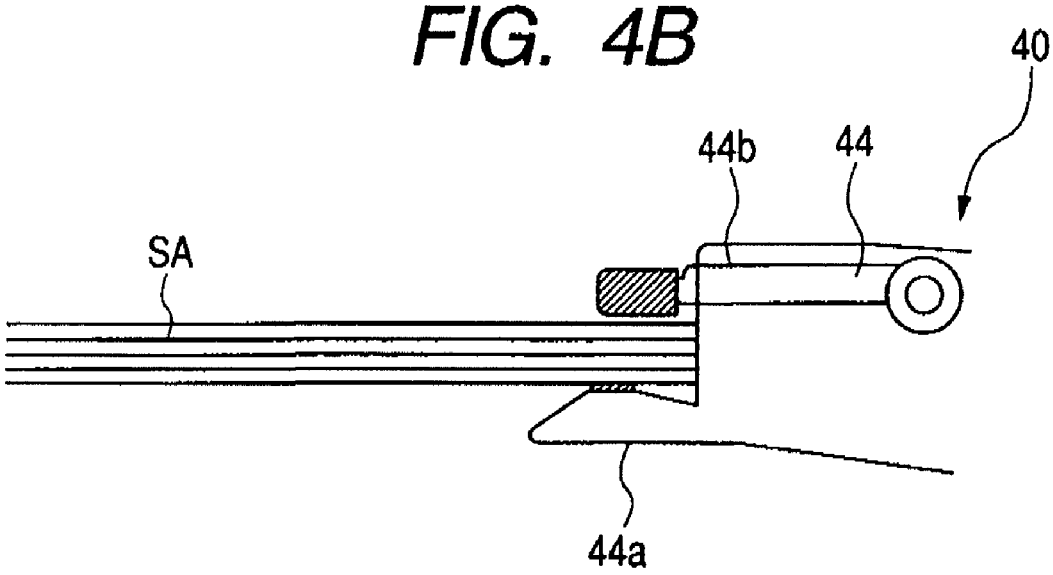
Figure 5:
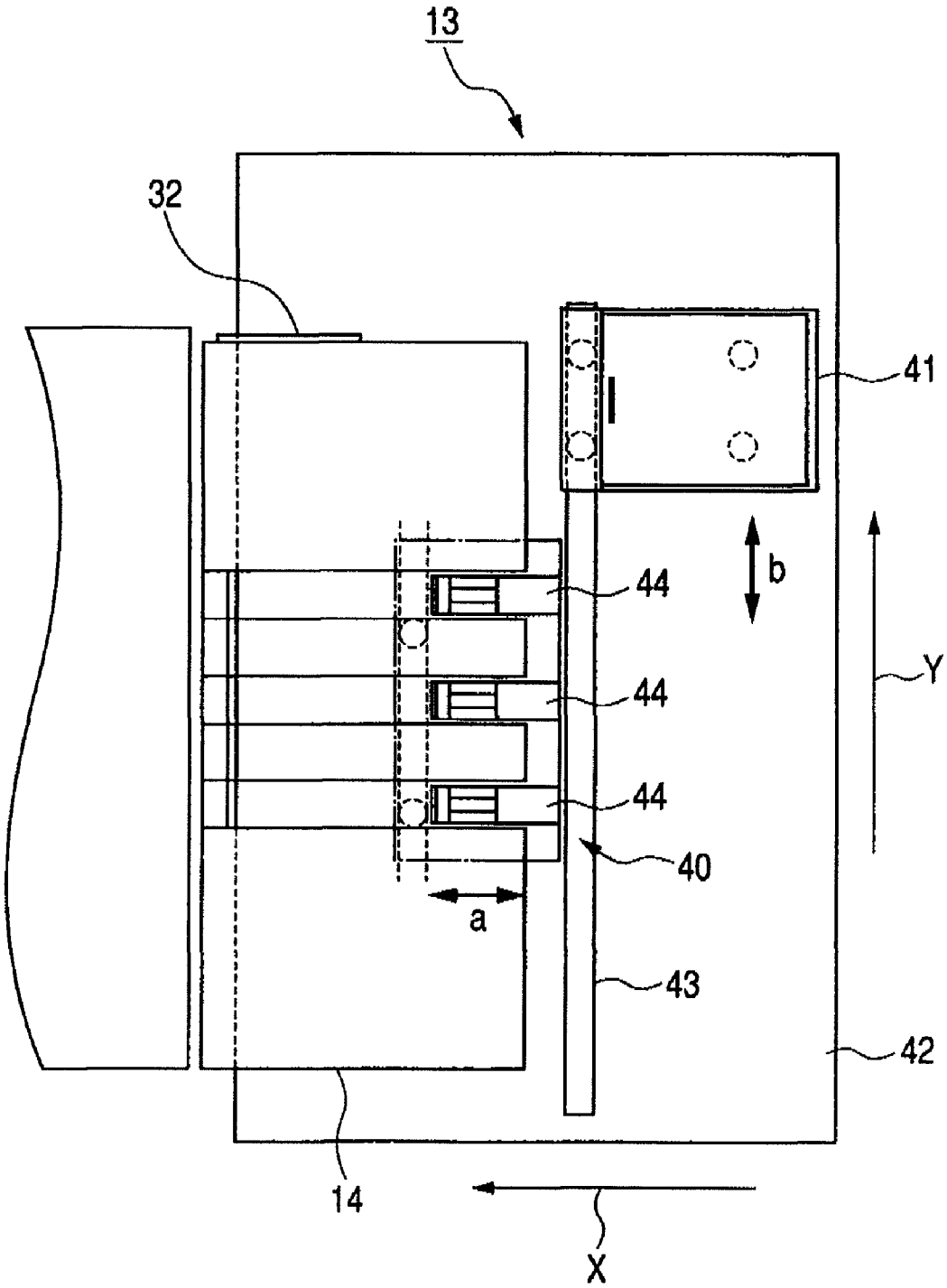
FIG. 5 is a plan view illustrating a configuration of the gripper/stapler portion of the sheet processing apparatus.

Next, the gripper/stapler portion 13 will be described. FIGS. 4A and 4B are schematic views illustrating operation states where a gripper unit 40 nips a sheet bundle SA, and FIG. 5 is a plan view illustrating a configuration of the gripper/stapler portion 13. As illustrated in FIG. 5, the gripper/stapler portion 13 includes the gripper unit 40 that grips and moves the sheet bundle aligned on the processing tray 14. The gripper/stapler portion 13 further includes a stapler unit 41 that binds the sheet bundle SA moved to a staple process position by the gripper unit 40.

The gripper unit 40 includes three pairs of grip arms 44 configured to grip the sheet bundle SA aligned on the processing tray 14. As illustrated in FIGS. 4A and 4B, each pair of the grip arms 44 includes a fixed grip arm 44*a* configured to support a lower surface of the sheet bundle SA, and a movable grip arm 44*b* that is provided opposite to and above the fixed grip arm 44*a*, and presses an upper surface of the sheet bundle SA. Further, the gripper unit 40 is configured to be freely movable in a direction (parallel to the transport direction X of sheets) indicated by an arrow "a" in FIG. 5, to thereby nip the sheet bundle SA by the grip arm pairs 44 and move the sheet bundle SA to the staple position. Note that, in the gripper unit 40 of this embodiment, as illustrated in FIG. 5, the three pairs of grip arms 44 are provided, and the three pairs of grip arms 44 are arranged at positions spaced apart from one another at a predetermined interval in the width direction Y.

The stapler unit 41 incorporates a staple head and an anvil block therein. The stapler unit 41 bends a needle-like staple into a shape of a square bracket, presses the bent staple into the sheet bundle SA, and bends tip ends of the bent staple by the anvil block, to thereby bind the sheet bundle SA. In this embodiment, the stapler unit 41 having the following general configuration is employed. That is, the staple head is attached to one of upper and lower lever members (not shown) of which proximal ends are pivotally supported with respect to each other, and the anvil block is attached to the other of the upper and lower lever members. Then, the upper and lower lever members are moved reciprocally by a drive cam member (not shown) between a separate position and a pressure contact position.

As illustrated in FIG. 5, on a base 42 on a bottom portion of the processing apparatus C, a guide rail 43 for moving the stapler unit 41 in a direction (parallel to the width direction Y) indicated by an arrow "b" in FIG. 5 is provided. This guide rail 43 is formed longer than a width of the maximum sheet so as to bind both end portions of the sheets.

With the configuration described above, after the sheet bundle SA aligned on the processing tray 14 is gripped by the grip arm pairs 44 of the gripper unit 40, the gripper unit 40 is moved in the direction (reverse to the transport direction X) indicated by the arrow "a", to move the sheet bundle SA to the staple position. Note that, at this time, the stopper member 31 as already described with reference to FIG. 3 has been moved to the retreat position in which the stopper member cannot hamper the movement of the sheet bundle SA by the gripper unit 40. Then, when the sheet bundle SA has been moved to the staple position by the gripper unit 40, an end portion of the sheet bundle SA is subjected to a binding process by the stapler unit 41.

Note that, available examples of the binding process include an end binding process for implementing the binding process for one side of the sheet bundle SA, and a two-spot binding process for implementing the binding process for predetermined two spots of the sheet bundle SA. The stapler unit 41 is moved in the direction indicated by the arrow "b" along the guide rail 43, and executes any one binding process of the end binding process and the two-spot binding process.

The sheet bundle SA subjected to the binding process is gripped by the grip arm pairs 44 of the gripper unit 40 one more time. Then, in a state of gripping the sheet bundle SA by the grip arm pairs 44, the gripper unit 40 is moved in the direction (transport direction X) indicated by the arrow "a", that is, toward the containing portion 10. In such a way, the sheet bundle SA is moved so as to be thrust out to the containing portion 10. After moving the sheet bundle SA to the containing portion 10, the gripper unit 40 releases the grip for the sheet bundle SA by the grip arm pairs 44, moves the grip arm pairs 44 to an intermediate position between the stopper member 31 and the staple position, and stands-by for a process for the next sheet bundle.

Next, the containing portion 10 will be described based on FIG. 3. In the containing portion 10 located on the downstream side of the processing tray 14 in the transport direction X, the multiple stack trays 50 and 51 are arranged. Note that, in this embodiment, the containing portion 10 includes the first stack tray 50 and the second stack tray 51, and the first stack tray 50 and the second stack tray 51 are selectively connected to the processing tray 14. Then, as illustrated in FIG. 3, a sheet holding-down claw 34 is provided in the processing tray 14. The sheet holding-down claw 34 holds down the sheets stacked on the sheet placing surface 50*a* or 51*a* of the stack tray 50 or 51.

As described above, in this embodiment, the guide member 61, which guides each of the sheets at the time of being lifted, and suppresses the curling of the sheet at the time of being lowered, is provided to be slidable in the width direction Y. Then, the guide member 61 is moved in the width direction Y integrally with the shift rollers 30, and hence even in the case where the holding-down guide 61*a* abuts against the alignment member 32 prior to the sheet, the guide holder 61*b* is moved while being slid integrally with the sheet. In such a way, the sheet can be allowed to abut against the alignment member 32. As a result, regardless of the sheet size, the buckling of the sheet in the width direction can be suppressed when the positions of the sheets in the width direction Y is aligned.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications NO. 2009-212458, filed Sep. 14, 2009, and No. 2010-161371, filed Jul. 16, 2010 which are hereby incorporated by reference herein in their entirety.

What is claimed is:

1. A sheet processing apparatus that processes sheets transported in a predetermined transport direction and stacked on a processing tray, the sheet processing apparatus comprising:

a sheet moving device configured to be brought into contact with an upper surface of a sheet stacked on the processing tray and to be moved in a width direction intersecting with the predetermined transport direction to move the sheet in the width direction;

an alignment member against which a side edge of the sheet moved in the width direction by the sheet moving device is brought into abutment, to align the sheet;

a guide member configured to hold down the sheet from above at a predetermined position between the sheet moving device and the alignment member when the sheet moving device is in contact with the upper surface of the sheet; and a regulating member configured to regulate a movement of the guide member in the width direction by abutting against the guide member, wherein the guide member is moved integrally with the sheet moving device when the sheet moving device is moved in the width direction, wherein the guide member is configured to slide in the width direction with respect to the sheet moving device, and wherein, when the sheet moving device is moved in the width direction integrally with the guide member, and the guide member abuts against the regulating member, the guide member is maintained at a position in which the guide member abuts against the regulating member until the sheet moving device causes the sheet abut against the alignment member to align the sheet.

2. A sheet processing apparatus according to claim 1, wherein the regulating member and the alignment member are the same member.

3. A sheet processing apparatus according to claim 1, wherein the guide member comprises a curl presser configured to press a curl of the sheet.

4. A sheet processing apparatus according to claim 1, wherein the guide member is urged toward the alignment member by a spring.

5. A sheet processing apparatus according to claim 1, wherein the sheet moving device is configured to be swingable between a retreat position above the processing tray and a contact position in which the sheet moving device is in contact with the upper surface of the sheet stacked on the processing tray, and wherein, when the sheet moving device is located at the retreat position, the guide member is on standby at a position of bringing the sheet onto the processing tray, the sheet being transported in the predetermined transport direction from an upstream side of the sheet moving device, whereas, when the sheet moving device is located at the contact position, the guide member holds down the sheet from above.

6. An image forming apparatus, comprising:

an image forming apparatus main body; and a sheet processing apparatus as recited in claim 1, for processing a sheet.

* * * * *